United States Patent [19]

Berg

[11] 4,248,351

[45] Feb. 3, 1981

[54] PACKAGING CONTAINER WITH A POURING SPOUT

[75] Inventor: Nils R. F. Berg, Dalby, Sweden

[73] Assignee: Tetra Pak International AB, Lund, Sweden

[21] Appl. No.: 917,201

[22] Filed: Jun. 20, 1978

[30] Foreign Application Priority Data

Jun. 20, 1977 [SE] Sweden ..... 7707098

[51] Int. Cl.[3] ..... B65D 5/74

[52] U.S. Cl. ..... 206/620; 229/17 R

[58] Field of Search ..... 229/17 R, 176; 206/620; 93/36 DA

[56] References Cited

U.S. PATENT DOCUMENTS

| | | | |
|---|---|---|---|
| 3,083,876 | 4/1963 | Schneider et al. | 206/620 |
| 3,178,090 | 4/1965 | Connell | 229/17 R |
| 3,232,514 | 2/1966 | Swede et al. | 229/17 R |
| 3,347,444 | 10/1967 | Rausing et al. | 229/17 R |
| 3,892,347 | 7/1975 | Egleston | 229/17 R |
| 3,924,796 | 12/1975 | Rausing et al. | 229/17 G |
| 4,078,715 | 3/1978 | Larsson et al. | 229/17 R |

FOREIGN PATENT DOCUMENTS

| | | | |
|---|---|---|---|
| 2441189 | 4/1975 | Fed. Rep. of Germany | 229/17 R |

*Primary Examiner*—Stephen P. Garbe

*Attorney, Agent, or Firm*—Burns, Doane, Swecker & Mathis

[57] ABSTRACT

A packing container with an unfoldable pouring spout which has an inherent tendency to assume an unfolded position when the container has been opened is disclosed. The ability of the pouring spout to tend to assume the unfolded position is achieved by having certain folding lines of the container weaken the material of the container to an appreciably greater extend than certain other folding lines of the container. The relative difference in weakening of the material caused by the folding lines utilizes the elasticity of the packing material to urge the pouring spout to unfold.

13 Claims, 2 Drawing Figures

PACKAGING CONTAINER WITH A POURING SPOUT

The present invention relates to a packing container with unfoldable pouring spout of the type which comprises a number of triangular wall panels delimited by means of folding lines, namely a first wall panel joined to a side face of the packing container and two other wall panels joined to this first wall panel as well as to the upper surface of the packing container.

Packing containers of the one-way type for the packing of e.g. liquid contents are now frequently made of a packing laminate comprising a relatively thick and rigid base layer of fibrous material, e.g. paper, which base layer is covered on both sides with liquid-tight, homogeneous plastic layers. The manufacture of the packing container takes place so that the packing laminate is folded and sealed, and formed in a suitable manner so as to obtain a packing container of the desired, e.g. parallelepipedic, shape. To facilitate the forming of the packing container, the packing laminate is provided with folding lines or crease lines which generally are constituted of linear compressions of the material, and which are intended to facilitate and guide the folding so that the packing container on forming obtains the desired shape.

Many of the known packing containers which are manufactured by folding and sealing of laminated material have at their upper end an opening arrangement which comprises a pouring spout that is unfoldable after or in connection with the opening of the package. The pouring spout is usually placed at the intersection between one of the side faces of the package and the upper surface of the package and comprises a number of triangular wall panels delimited by means of folding lines, which after the opening of the packing container form an outlet duct through which the contents of the packing container can be emptied out in the form of a well convergent jet.

The known designs of pouring spouts in the great majority of cases function well and make possible a secure emptying out of the contents of the packing container. In certain types of packing containers, however, the unfolding and the forming of the pouring spout may be associated with great difficulties and in certain other types of packing containers the pouring spout is liable, after the unfolding, to collapse again, which naturally leads to a breaking up of the pouring jet and consequent spilling.

It is an object of the present invention to overcome the disadvantage of earlier known pouring spouts and to provide a packing container with an unfoldable pouring spout which operates satisfactorily, which is easy to form so that it folds out and remains in the desired position.

These and other objects have been achieved in that a packing container with unfoldable pouring spout of the type which comprises a number of triangular wall panels delimited by means of folding lines, namely a first wall panel joined to a side face of the packing container, and two other wall panels joined to this first wall panel as well as to the upper surface of the packing container, is given the characteristic that the folding lines located between the other wall panels and the upper surface of the packing container consist of weakening lines which weaken the packing material to an appreciably greater extent that the folding line located between the first wall panel and the side face of the packing container. By this design a pouring spout is obtained which after the opening of the package has an inherent tendency of its own accord to assume an unfolded position.

A preferred embodiment of the arrangement in accordance with the invention has been given the further characteristic that the two other wall panels are delimited on their upper edge from a sealing fin extending over the upper surface of the packing container by means of a tearing indication extending up to the base line of the sealing fin and whose end parts extending to the middle of the sealing fin converge in an acute angle with the said weakening lines.

A further preferred embodiment of the arrangement in accordance with the invention has been given the further characteristic that the weakening lines consist of perforation lines partially penetrating the packing material.

A further preferred embodiment of the invention has been given the further characteristic that in laminated packing material comprising a carrier layer and a liquid-tight layer, the perforations are arranged in the carrier layer.

By making the specially solidly marked weakening lines into perforation lines with the perforation partially penetrating through the material, weakening lines are produced which substantially facilitate the folding of the material and ensure a simple unfolding of the pouring spout.

An embodiment of the invention will be described in detail in the following with reference to the enclosed diagrammatic drawings.

Figure 1:
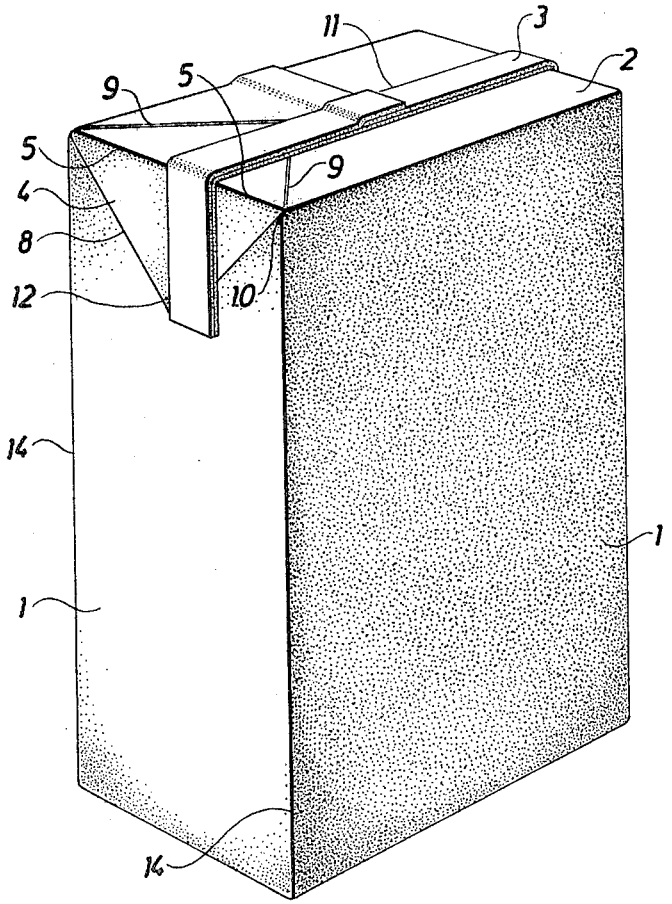
FIG. 1 shows a closed, parallelepipedic packing container with unfoldable pouring spout in accordance with the invention.

The packing container shown in FIG. 1 is of parallelepipedic shape and has side walls 1, an upper end wall 2 and a bottom wall, which however is not visible on the drawings. The packing container is manufactured from the laminated material mentioned earlier which comprises a carrier layer of paper covered on both sides with thermoplastic material. The material is relatively rigid and to facilitate the folding necessary for the forming of the parallelepipedic packing container, the material is provided with a number of folding or crease lines which are partly visible on the drawing. The packing container is manufactured in that web-shaped packing material is folded over to a tube which is filled with the intended contents. Subsequently the filled tube is pressed flat and transversely sealed in narrow zones extending transversely across the tube. After cutting through the said transverse sealing zones completely filled cushion-shaped packages are obtained which are converted by a forming process to packages of the parallelepipedic shape shown. The transverse sealing zone forms a sealing fin 3 which extends over the upper side 2 of the package. A corresponding sealing fin extends over the bottom wall of the packing container, but is not visible in the drawings. The sealing fin 3 is folded down, when the packing container is formed, to lie against the upper end wall 2 of the packing container. During the forming process of the completely filled packing container from cushion shape to parallelepipedic shape a material surplus arises which is in the form of four triangular double-walled lugs 4 situated at the corner parts of the packing container. Two of these four corner lugs 4 are folded in and sealed to the bottom wall of the packing container (not shown), whilst the two others are sealed to the side wall 1 of the packing container, only one lug 4 being visible in FIG. 1. This lug 4 comprises part of the sealing fin 3, triangular panels 5 located on either side of the same which hang together and are partly constituted of material from the upper end wall 2 of the packing container, and a triangular panel 6 located underneath the folded-down part of the corner lug 4 (FIG. 2), which constitutes a continuation of the side wall 1. The triangular panel 6 is delimited from the side wall 1 by means of a crease line 7 and from the two triangular panels 5 by means of crease lines 8. The crease lines 7 and 8 are of the conventional type, that is to say they consist of linear compressions of the material produced earlier, e.g. during the manufacture of the material. The crease lines 7 and 8 guide the folding, and are sufficiently strong to impart to the material, when the same is acted on, a tendency to fold along the lines, but they do not to any great extent facilitate the folding. Thus the folding or crease line 7, for example, is not so strong that in the absence of external forces side wall panel 1 and the triangular wall panel 6 would not show a clear tendency to remain in one plane with each other.

Between the two wall panels 5 and the upper side 2 of the packing container (which could be regarded as consisting of two parts separated from one another by means of the sealing fin 3) there are crease lines 9 which extend between the adjacent corner 10 and a base line 11 in the transition between the sealing fin 3 and the upper surface 2. The folding line 9 is in the form of a weakening line which weakens the packing material to such an extent that it is folded along the folding line already under the effects of a very light action.

The figures also indicate that the base line 11 extending between the sealing fin and the upper surface 2 of the packing container is, along a part of the length of the sealing fin 3, in the form of a breaking indication 12 which more particularly extends from the one end of the sealing fin 3 to or close by the point 13 at which the folding lines 9 meet the base line 11. In this manner an opening arrangement is produced, the function of which will be described in more detail in the following.

When the packing container in accordance with the invention is to be opened in the first place the folded-down corner lug 4 is detached from the side wall 1 of the packing container, which is done simply by breaking with the finger the seal between the corner lug 4 and the side wall 1 and folding upwards the corner lug 4. Then the end of the sealing fin 3 located on top of the said corner lug is gripped and the perforation 12 between the two wall panels 5 and the sealing fin is broken, whereupon the pouring spout assumes the position shown in FIG. 2. Depending on the rigidity and quality of the packing laminate it may be necessary to exert a slight pressure on the corner points 10 of the packing container to ensure the folding out of the pouring spout.

When the packing container is to be re-closed the pouring spout can be given a third position, partially tucked in under the face end of the sealing fin 3. The pouring spout is brought into this position by squeezing the panel 6 in underneath the sealing fin 11 whereby the two triangular panels 5 situated at the sides will be folded along lines which substantially represent continuations of the vertical edges 14 between the side wall panels 1 of the packing container. The pouring spout is locked in this re-closed position in that the upper corner of the triangular panel 6, which is located in the tearing indication 12, is moved under the sealing fin and is retained by the same in a position near the meeting point 13 of the weakening lines 9 and the base line 11 of the sealing fin 3.

On renewed opening of the packing container closed in this manner the free end of the sealing fin 3 merely is folded out, whereby the pouring spout automatically unfolds to the position shown in FIG. 2 owing to the inherent rigidity of the packing material and the adapting of the strength of the different folding or crease lines which will be explained in detail in the following.

Figure 2:
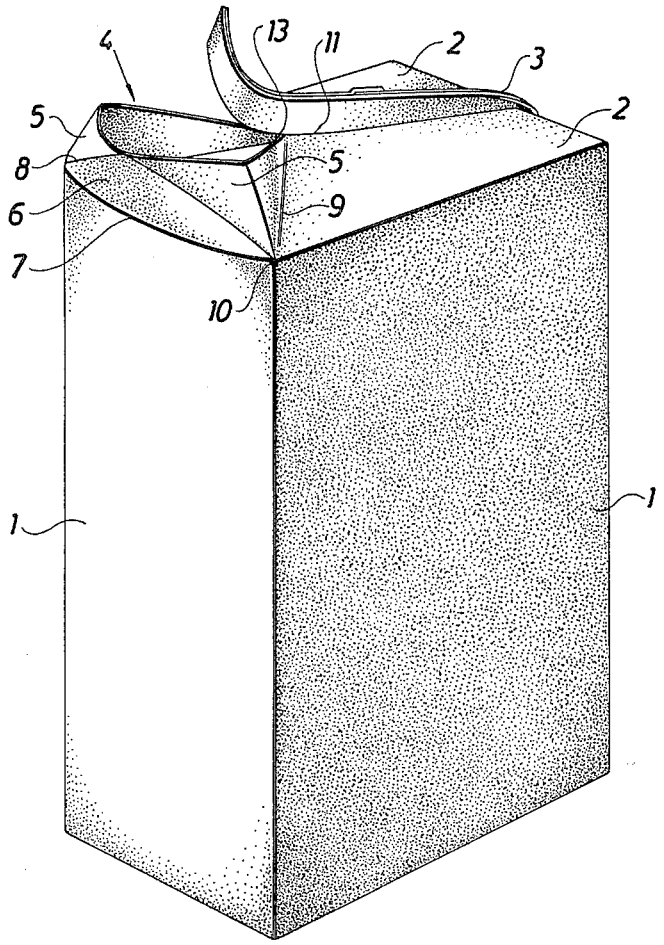
FIG. 2 shows the packing container in accordance with FIG. 1 after the opening of the same and unfolding of the pouring spout in accordance with the invention.

In FIG. 2 the pouring spout is shown in the position which it will assume when it is not subjected to the action of external forces. When the packing container is in its unopened state, as shown in FIG. 1, and the folded-down corner lug 4 is detached from the side wall 1 of the packing container, the lug will automatically assume a position which is substantially in the same plane as the upper wall 2 of the packing container. The reason for this is that on the one hand the two triangular panels 5 endeavour to assume a plane position whilst on the other hand the folded-down sealing fin 3, which is only retained in folded-down position because of its folded-down end portions, will lift itself up and assume a position at a substantially right angle with the upper wall of the packing container at the detached end. In this position it is easy to grip the end of the sealing fin 3 and separate the sealing fin from the two panels 5 along the tearing indication 12. After breakage of the tearing indication the end of the sealing fin 3 will assume a position which substantially corresponds to that shown in FIG. 2. It then becomes possible for the pouring spout to rise from the flattened position in a plane with the upper side 2 to the position shown in FIG. 2, and this in fact occurs depending on the combined action of substantially three factors. In the first place, owing to the inherent elasticity of the material and the weak folding line 7, the triangular panel 6 will endeavour to assume a position in a plane with the adjoining side wall 1. Secondly, the two triangular side panels 5 will then curve outwards, since the centre portions of the panel endeavour to end up in a straight line with the edges 14 of the packing container. Finally, if the rigidity and elasticity inherent in the material should be capable of urging the pouring spout into the position shown, it is a condition that the folding lines 9 between the panels 5 and the end surface 2 of the packing container should be made up of weakening lines which appreciably weaken the material and ensure that the necessary folding of the panels 5 in relation to the end surface can take place. If the folding lines 9 are designed as conventional relatively weak crease lines, the triangular panels 9 will endeavour to assume a position in a plane with the upper end surface 2 of the packing container and will thus prevent the complete unfolding of the pouring spout. In spite of the presence of the solidly marked weakening line 9 it may be necessary in the case of certain materials to provide a certain afteradjustment of the shape of the pouring spout by exerting some pressure on the two corner points 10 of the packing container in direction of one another.

It has been found that the pouring spout functioning best is that where the side wall panels 5 are designed in the form of isosceles triangles, the two sides of equal length coinciding with the folding lines 8 and 9. For the rest the angle between the folding lines of the pouring spout and the relative sizes etc. can be determined in relation to the size of the package and the desired size of the pouring spout.

On opening of a re-closed package, that is to say a package that has been re-closed by tucking in the triangular wall panel 6 in the direction of the centre of the package and squeezing it under the sealing fin 3, the pouring spout is unfolded automatically on folding away of the loose end of the sealing fin 3, since the triangular panel 6 and the side wall panel located underneath it will now endeavour to return to a common plane, at the same time as the central parts of wall panels 5 try to assume a position in line with the edges 14 of the packing container.

Since it has been found difficult or impossible in certain types of material to bring about the two solidly marked folding lines 7 by means of a known creasing technique, that is to say by linear compression of the material, the weakening lines in accordance with the invention are realized as perforation lines which partly penetrate the packing material. In packing containers for e.g. liquid contents it is essential in this case that the inner, impervious layer should not be perforated, and the perforations are therefore preferably arranged in the carrier layer of the packing material. More particularly, the perforation lines are in the form of a number of holes or slits punched in series into the carrier layer and separated by intact, non-processed sections of the carrier layer. The ratio between the length of the punched and unpunched portions determines the strength of the material against folding along the weakening line and is chosen as a function of the type of material, its thickness, rigidity and the like. Naturally the strength of the material also has to be borne in mind so that the weakening line does not give rise to a breakage of the material.

To ensure a rectilinear and neat edge between the two corners 10 it may also be appropriate to guide the folding at the said edge by means of a crease line.

The arrangement in accordance with the invention has been described in connection with a parallelepipedic packing container, but it can of course also be applied to other forms of packing containers which have an upper surface of largely the same type as that which has been described. Thus the invention may be applied e.g. to packing containers of the so-called gable-top type, where the upper surface or surfaces in a ridge-like manner form an angle with each other and where in closed condition of the package the corner lugs are tucked in under the two upper surfaces. Apart from the attachment of the corner lug to the side face of the packing container and the actual opening phase, the pouring spout in this type of package too can by suitable dimensioning of the crease lines incorporated be given, if not a self-unfolding function, at least one that largely facilitates unfolding and moreover ensures that the pouring spout remains in the unfolded position.

The arrangement in accordance with the invention is thus applicable to a great number of different types of packages and provides an optimum solution of the problem of the formation of a securely functioning pouring spout.

I claim:

1. A packing container with an unfoldable pouring spout, comprising:

a packing container having a pouring spout that automatically assumes an unfolded position, said pouring spout having a plurality of triangular wall panels defined by a plurality of folding lines, namely a first wall panel joined to a side face of the packing container and a pair of second wall panels each joined to the first wall panel as well as to an upper side of the packing container; and means included on said packing container for causing the pouring spout to automatically unfold from a foldeddown position to an unfolded position, said means including:

folding lines located between the second wall panels and the upper side of the packing container; and a folding line located between the first wall panel and the side face of the packing container;

wherein said folding lines located between the second wall panels and the upper side of the packing container consist of weakening lines which weaken the packing material to an appreciably greater extent than said folding line located between the first wall panel and the side face of the packing container.

2. A packing container according to claim 1 wherein the second wall panels are defined on their upper edge from a sealing fin extending over the upper side of the packing container by a breaking indication, said breaking indication extending along a base line of the sealing fin from one end of said sealing fin to a point at which the weakening lines meet the base line, and said breaking indication forming an acute angle with said weakening lines.

3. A packing container according to claim 1 or claim 2 wherein the weakening lines consist of perforation lines partially penetrating the packing material.

4. A packing container in accordance with claim 3, further comprising a laminated packing material including a carrier layer and a liquid-tight layer, wherein the perforations are arranged in the carrier layer.

5. A container having a pouring spout that automatically assumes an open configuration, comprising:

a sheet of packing material; and means included on said sheet of packing material for causing the pouring spout to automatically unfold from a closed configuration to the open configuration, said means including a plurality of folding lines along which the sheet of packing material is weakened, said plurality of folding lines including:

at lease one folding line defining the pouring spout of the container; and two or more additional folding lines further defining the pouring spout of the container, at least one of said two or more additional folding lines being weakened to an appreciably greater extent than said at least one folding line;

said sheet of packing material tending to assume an unfolded position along said at least one folding line and tending to assume a folded position along said at least one of the two or more additional folding lines as said pouring spout automatically assumes the open configuration.

6. The container of claim 5 further comprising still further folding lines of the sheet of packing material defining the container whereby the container and pouring spout are formed of the single sheet of packing material.

7. The container of claim 5 wherein the at least one of the two or more additional folding lines of the sheet of packing material is provided with perforations extending at least partly through the packing material.

8. The container of claim 5 wherein the packing material includes a carrier layer and a liquid-tight layer and wherein the at least one of the two or more additional folding lines of the sheet of packing material is provided with perforations extending only through the carrier layer.

9. The container of claim 5 wherein the packing material is elastic.

10. A method of forming a container having a pouring spout that automatically assumes an open configuration, comprising the steps of:

providing means for causing the pouring spout to automatically unfold from a closed configuration to an open configuration, including:

weakening a sheet of packing material along at least one folding line defining the pouring spout of the container; and further weakening the sheet of packing material to an appreciably greater extent along at least one of two or more additional folding lines further defining the pouring spout of the container whereby the pouring spout will automatically assume the open configuration;

said sheet of packing material tending to assume an unfolded position along said at least one folding line and tending to assume a folded position along said at least one of the two or more additional folding lines as said pouring spout automatically assumes the open configuration.

11. The method of claim 10 further comprising the steps of:

forming the container and the pouring spout from a single sheet of packing material.

12. The method of claim 10 wherein the further weakening to an appreciably greater extent of the at least one of the two or more additional folding lines includes perforating the sheet of packing material along the at least one of the two or more additional folding lines at least partially through the packing material.

13. The method of claim 12 wherein the packing material includes a carrier layer and a liquid tight layer, the perforating penetrating only through the carrier layer.

* * * * *